US005844492A

United States Patent [19]

Buffin, Sr.

[11] Patent Number: 5,844,492

[45] Date of Patent: Dec. 1, 1998

[54] WATER LEAKAGE DETECTION AND GAS SHUT-OFF DEVICE

[76] Inventor: John J. Buffin, Sr., 14 Rudner Ave., Hamilton, N.J. 08619-3939

[21] Appl. No.: 942,948

[22] Filed: Oct. 2, 1997

[51] Int. Cl.[6] ..... G08B 17/10

[52] U.S. Cl. ..... 340/632; 340/633; 340/634; 340/605; 340/604; 137/312; 137/65

[58] Field of Search ..... 340/632, 633, 340/634, 605, 690; 236/20 R, 1 H, 21 R, 21 B, 26 A; 126/363; 261/DIG. 31; 237/19, 10; 137/65

[56] References Cited

U.S. PATENT DOCUMENTS

| | | | |
|---|---|---|---|
| 4,126,857 | 11/1978 | Lancia et al. | 340/620 |
| 4,730,637 | 3/1988 | White | 137/62 |
| 4,845,472 | 7/1989 | Gordon et al. | 340/605 |
| 4,995,415 | 2/1991 | Weber | 137/1 |
| 5,048,324 | 9/1991 | Thompson | 73/40.7 |
| 5,188,143 | 2/1993 | Krebs | 137/312 |
| 5,240,022 | 8/1993 | Franklin | 137/1 |
| 5,280,802 | 1/1994 | Comuzie, Jr. | 137/65 |
| 5,334,973 | 8/1994 | Furr | 340/605 |
| 5,632,302 | 5/1997 | Lenoir, Jr. | 137/312 |

*Primary Examiner*—Jeffery A. Hofsass
*Assistant Examiner*—Toan N. Pham

[57] ABSTRACT

A gas leak and cut-off device is provided including a gas-powered hot water heater having a cylindrical configuration with a circular top face, a circular bottom face, and a cylindrical periphery formed therebetween. The bottom face has a plurality of stanchions coupled thereto and extending downwardly for engaging a recipient surface. A gas input pipe is provided having a first end connected to a gas supply and a second end connected to the periphery of the hot water heater for supplying gas thereto to heat water. A plurality of monitors are each mounted in spaced relationship on the recipient surface with the outboard ends in line with the periphery of the water heater. Each monitor is adapted for generating an activation signal only during the detection of fluid. A control valve is mounted on the horizontal portion of the gas input pipe and has an unbiased open orientation for allowing gas to be supplied to the water heater during the lack of receipt of power and a biased closed orientation for precluding gas from being supplied to the water heater only during the receipt of power. Control circuitry is connected between the monitors and control valve for supplying power to the control valve upon the receipt of at least one activation signal.

1 Claim, 2 Drawing Sheets

WATER LEAKAGE DETECTION AND GAS SHUT-OFF DEVICE

BACKGROUND OF THE INVENTION

1. Field of the Invention

The present invention relates to a gas leak and cut-off device and more particularly pertains to detecting gas and other liquids in the vicinity of a water heater for the purpose of ceasing a supply of gas to the water heater.

2. Description of the Prior Art

The use of water cut-off devices is known in the prior art. More specifically, water cut-off devices heretofore devised and utilized for the purpose of for protecting against flooding are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,240,022; U.S. Pat. No. 5,419,308; U.S. Pat. No. 4,488,567; and U.S. Pat. No. 5,345,224.

In this respect, the gas leak and cut-off device according to the present invention substantially departs from the conventional concepts and designs of the prior art, and in so doing provides an apparatus primarily developed for the purpose of detecting gas and other liquids in the vicinity of a water heater for the purpose of ceasing a supply of gas to the water heater.

Therefore, it can be appreciated that there exists a continuing need for a new and improved gas leak and cut-off device which can be used for detecting gas and other liquids in the vicinity of a water heater for the purpose of ceasing a supply of gas to the water heater. In this regard, the present invention substantially fulfills this need.

SUMMARY OF THE INVENTION

In view of the foregoing disadvantages inherent in the known types of water cut-off devices now present in the prior art, the present invention provides an improved gas leak and cut-off device. As such, the general purpose of the present invention, which will be described subsequently in greater detail, is to provide a new and improved gas leak and cut-off device which has all the advantages of the prior art and none of the disadvantages.

To attain this, the present invention essentially comprises a gas-powered hot water heater having a cylindrical configuration with a circular top face, a circular bottom face, and a cylindrical periphery formed therebetween. As shown in FIGS. 1 & 2, the bottom face has four stanchions coupled thereto which extend downwardly and each terminate with a circle base plate for engaging a recipient surface. Associated therewith is a gas input pipe with both a horizontal portion and a vertical portion. The gas input pipe has a first end connected to a gas supply and a second end connected to the periphery of the hot water heater for supplying gas thereto. FIG. 3 best shows one of a plurality of monitors included with the present invention. Each monitor includes an L-shaped bracket formed of a horizontal extent mounted on the recipient surface and a vertical extent integrally coupled to the horizontal extent and extending upwardly therefrom. A circular bore is formed in the vertical extent of each bracket. Each monitor further includes a rigid cylindrical housing with an outboard face, an inboard face, and a periphery formed therebetween defining an interior space. The outboard end has a plurality of unillustrated minuscule bores formed therein. The periphery of each housing has threaded grooves formed therein adjacent to the inboard end thereof. Each monitor further includes a hexagonal nut included for threadedly engaging the grooves of the housing when the inboard end of the housing is passed through the aperture of the bracket. As such, the housing is maintained in parallel relationship with the horizontal extent of the bracket. As shown in FIGS. 1 & 2, the monitors are mounted in spaced relationship on the recipient surface with the outboard ends in line with the periphery of the water heater. It should be noted that each monitor has an unillustrated liquid detection switch situated within the interior space of the corresponding housing for generating an activation signal only during the detection of fluid. Further provided is a control valve mounted on the horizontal portion of the gas input pipe, as shown in FIG. 1. During use, the control valve has an unbiased open orientation for allowing gas to be supplied to the water heater during the lack of receipt of power and a biased closed orientation for precluding gas from being supplied to the water heater only during the receipt of power. Finally, control circuitry is connected between the monitors and control valve for supplying power to the control valve. Such is effected upon the receipt of at least one activation signal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved gas leak and cut-off device which has all the advantages of the prior art water cut-off devices and none of the disadvantages.

It is another object of the present invention to provide a new and improved gas leak and cut-off device which may be easily and efficiently manufactured and marketed.

It is a further object of the present invention to provide a new and improved gas leak and cut-off device which is of a durable and reliable construction.

An even further object of the present invention is to provide a new and improved gas leak and cut-off device which is susceptible of a low cost of manufacture with regard to both materials and labor, and which accordingly is then susceptible of low prices of sale to the consuming public, thereby making such gas leak and cut-off device economically available to the buying public.

Still yet another object of the present invention is to provide a new and improved gas leak and cut-off device which provides in the apparatuses and methods of the prior art some of the advantages thereof, while simultaneously overcoming some of the disadvantages normally associated therewith.

Still another object of the present invention is to detect gas and other liquids in the vicinity of a water heater for the purpose of ceasing a supply of gas to the water heater.

Lastly, it is an object of the present invention to provide a new and improved gas leak and cut-off device is provided including a gas-powered hot water heater having a cylindrical configuration with a circular top face, a circular bottom face, and a cylindrical periphery formed therebetween. The bottom face has a plurality of stanchions coupled thereto and extending downwardly for engaging a recipient surface. A gas input pipe is provided having a first end connected to a gas supply and a second end connected to the periphery of the hot water heater for supplying gas thereto to heat water. A plurality of monitors are each mounted in spaced relationship on the recipient surface with the outboard ends in line with the periphery of the water heater. Each monitor is adapted for generating an activation signal only during the detection of fluid. A control valve is mounted on the horizontal portion of the gas input pipe and has an unbiased open orientation for allowing gas to be supplied to the water heater during the lack of receipt of power and a biased closed orientation for precluding gas from being supplied to the water heater only during the receipt of power. Control circuitry is connected between the monitors and control valve for supplying power to the control valve upon the receipt of at least one activation signal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
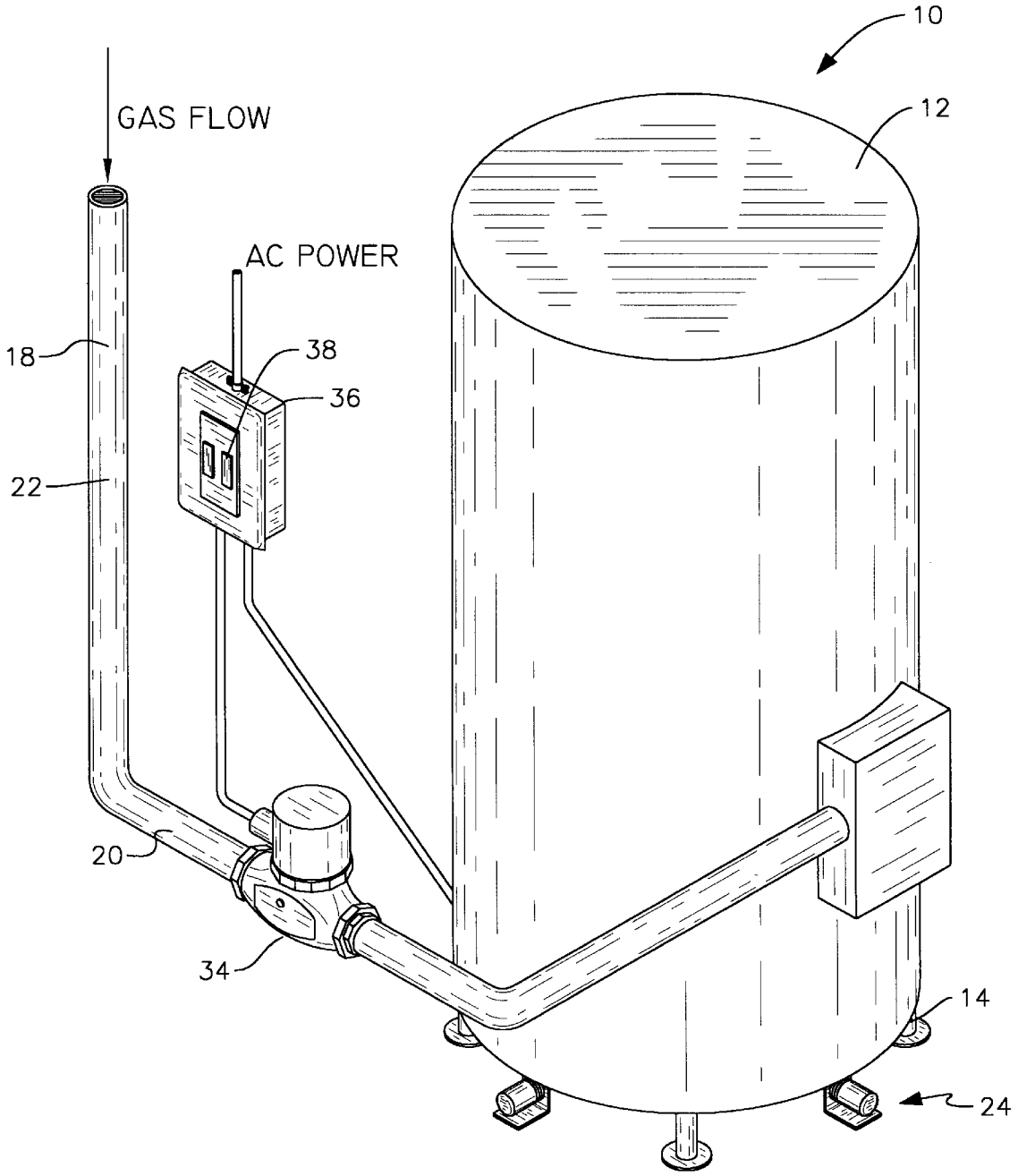
FIG. 1 is a perspective illustration of the preferred embodiment of the gas leak and cut-off device constructed in accordance with the principles of the present invention.

With reference now to the drawings, and in particular to FIG. 1 thereof, a new and improved gas leak and cut-off device embodying the principles and concepts of the present invention and generally designated by the reference numeral 10 will be described.

The present invention, the new and improved gas leak and cut-off device, is comprised of a plurality of components. Such components in their broadest context include a water heater, a plurality of monitors, a control valve, and control circuitry. Such components are individually configured and correlated with respect to each other so as to attain the desired objective.

Figure 2:
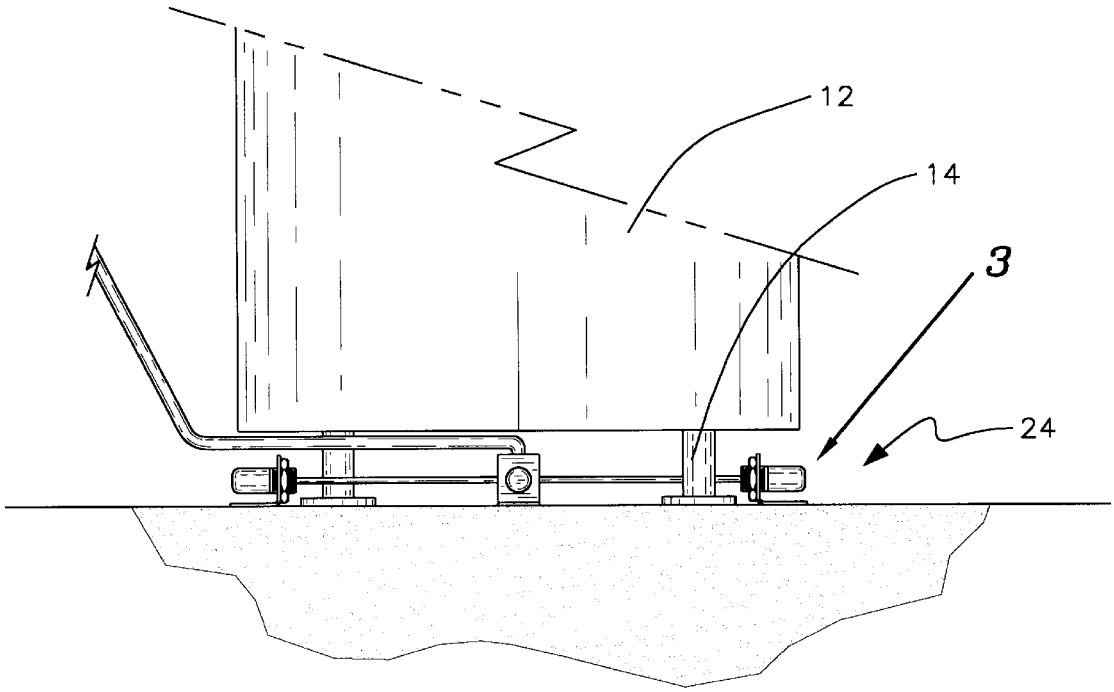
FIG. 2 is a side view of the water heater and monitors of the present invention.

More specifically, it will be noted that the system 10 of the present invention includes a gas-powered hot water heater 12 having a cylindrical configuration with a circular top face, a circular bottom face, and a cylindrical periphery formed therebetween. As shown in FIGS. 1 & 2, the bottom face has four stanchions 14 coupled thereto which extend downwardly and each terminate with a circle base plate 16 for engaging a recipient surface.

Associated therewith is a gas input pipe 18 with both a horizontal portion 20 and a vertical portion 22. The gas input pipe has a first end connected to a gas supply and a second end connected to the periphery of the hot water heater for supplying gas.

Figure 3:
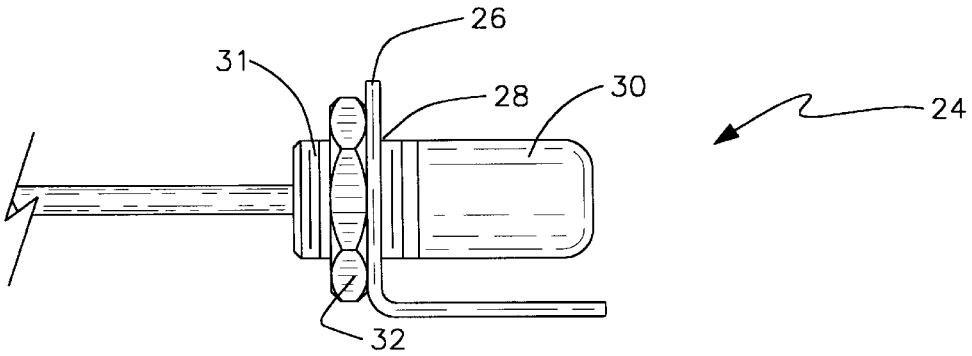
FIG. 3 is a side view of one of the monitors of the present invention.

FIG. 3 best shows one of a plurality of monitors 24 included with the present invention. Each monitor has an L-shaped bracket 26 formed of a horizontal extent mounted on the recipient surface and a vertical extent integrally coupled to the horizontal extent and extending upwardly therefrom. A circular bore 28 is formed in the vertical extent of each bracket.

Each monitor further includes a rigid cylindrical housing 30 with an outboard face, an inboard face, and a periphery formed therebetween defining an interior space. The outboard end has a plurality of unillustrated minuscule bores formed therein. The periphery of each housing has threaded grooves 31 formed therein adjacent to the inboard end thereof. For reasons that will become apparent later, the portion of the periphery with the grooves has a reduced diameter with respect to the remaining portion.

Each monitor further includes a hexagonal nut 32 included for threadedly engaging the grooves of the housing when the inboard end of the housing is passed through the aperture of the bracket. As such, the housing is maintained in spaced parallel relationship with the horizontal extent of the bracket. As shown in FIGS. 1 & 2, the monitors are mounted in spaced relationship on the recipient surface with the outboard ends in line with the periphery of the water heater. Ideally, four monitors are included and spaced 90 degrees with respect to an associated stanchion. It should be noted that each monitor has an unillustrated liquid detection switch situated within the interior space of the corresponding housing for generating an activation signal only during the detection of fluid. Such liquid detection switches are commonly known and commercially available.

Further provided is a control valve 34 mounted on the horizontal portion of the gas input pipe, as shown in FIG. 1. During use, the control valve has an unbiased open orientation for allowing gas to be supplied to the water heater during the lack of receipt of power and a biased closed orientation for precluding gas from being supplied to the water heater only during the receipt of power.

Finally, control circuitry 36, in the form of a ground fault circuit interrupter is connected between the monitors and control valve for supplying power to the control valve. Such is effected upon the receipt of at least one activation signal. Ideally, the power is continuously supplied until both the drying of the monitors and further the depression of a reset switch 38. Preferably, the control circuity is distanced from the water heater by at least 10 feet for safety purposes.

Further, the wires interconnecting the monitors and the control circuitry are ideally housed in long insulated pipes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved gas leak and cut-off device comprising, in combination:

a gas-powered hot water heater having a cylindrical configuration with a circular top face, a circular bottom face, and a cylindrical periphery formed therebetween, the bottom face having four stanchions coupled thereto and extending downwardly and each terminating with a circle base plate for engaging a recipient surface;

a gas input pipe with both a horizontal portion and a vertical portion, the gas input pipe having a first end connected to a gas supply and a second end connected to the periphery of the hot water heater for supplying gas thereto to heat water;

a plurality of monitors each including an L-shaped bracket formed of a horizontal extent mounted on the recipient surface and a vertical extent integrally coupled to the horizontal extent and extending upwardly therefrom with a circular bore formed therein, each monitors further including a rigid cylindrical housing with an outboard face, an inboard face, and a periphery formed therebetween defining an interior space, the outboard end having a plurality of minuscule bores formed therein and the periphery having threaded grooves formed therein adjacent to the inboard end thereof, wherein a portion of the periphery with the grooves formed therein has a reduced diameter, each monitor further having a hexagonal nut included for threadedly engaging the grooves of the housing when the inboard end of the housing is passed through the aperture of the bracket thereby securing the housing in parallel relationship with the horizontal extent of the bracket, the monitors mounted in spaced relationship on the recipient surface with the outboard ends in line with the periphery of the water heater, wherein four monitors are included spaced in 90 degrees relationship with respect to an adjacent one of the stanchions, whereby each monitor has a liquid detection switch situated within the interior space of the corresponding housing for generating an activation signal only during the detection of fluid;

a control valve mounted on the horizontal portion of the gas input pipe and having an unbiased open orientation for allowing gas to be supplied to the water heater during the lack of receipt of power and a biased closed orientation for precluding gas from being supplied to the water heater only during the receipt of power; and control circuitry distanced 10 feet from the water heater and connected between the monitors and control valve via wires housed in insulated pipes for supplying power to the control valve upon the receipt of at least one activation signal, wherein the power is supplied until the drying of the monitors and the depression of a reset switch.

* * * * *